United States Patent [19]

Bodmer

[11] 4,237,691

[45] Dec. 9, 1980

[54] PROCESS OF REMOVING WATER-SOLUBLE IMPURITIES FROM THE WORKING MEDIUM OF A STEAM POWER PLANT

[75] Inventor: Maurice Bodmer, Nussbaumen, Switzerland

[73] Assignee: BBC Brown, Boveri & Company, Limited, Baden, Switzerland

[21] Appl. No.: 944,784

[22] Filed: Sep. 22, 1978

[30] Foreign Application Priority Data

Sep. 26, 1977 [CH] Switzerland ..... 11746/77

[51] Int. Cl.[3] ..... F01K 21/06

[52] U.S. Cl. ..... 60/646; 60/657

[58] Field of Search ..... 60/646, 657, 677, 678, 60/679

[56] References Cited

U.S. PATENT DOCUMENTS

| | | | |
|---|---|---|---|
| 3,894,391 | 7/1975 | Heitmann et al. | 60/657 |
| 3,930,371 | 1/1976 | Schabert | 60/679 X |
| 4,055,048 | 10/1977 | Reed | 60/646 |

*Primary Examiner*—Allen M. Ostrager

*Attorney, Agent, or Firm*—Burns, Doane, Swecker & Mathis

[57] ABSTRACT

A process of removing water-soluble impurities from the working medium of a steam power plant is disclosed. Steam is bled from a high-pressure turbine downstream of the Wilson Line region. The steam is partially condensed, so that impurities in the steam are carried by the condensate. Moisture separators are disposed in the feed lines connecting the bleed lines with various heaters and the like. The bleed steam is supplied to the various heaters to heat the boiler feedwater and the working fluid of the turbine. The drains of the moisture separator are connected to a purification tank to remove the impurities from the condensate.

6 Claims, 1 Drawing Figure

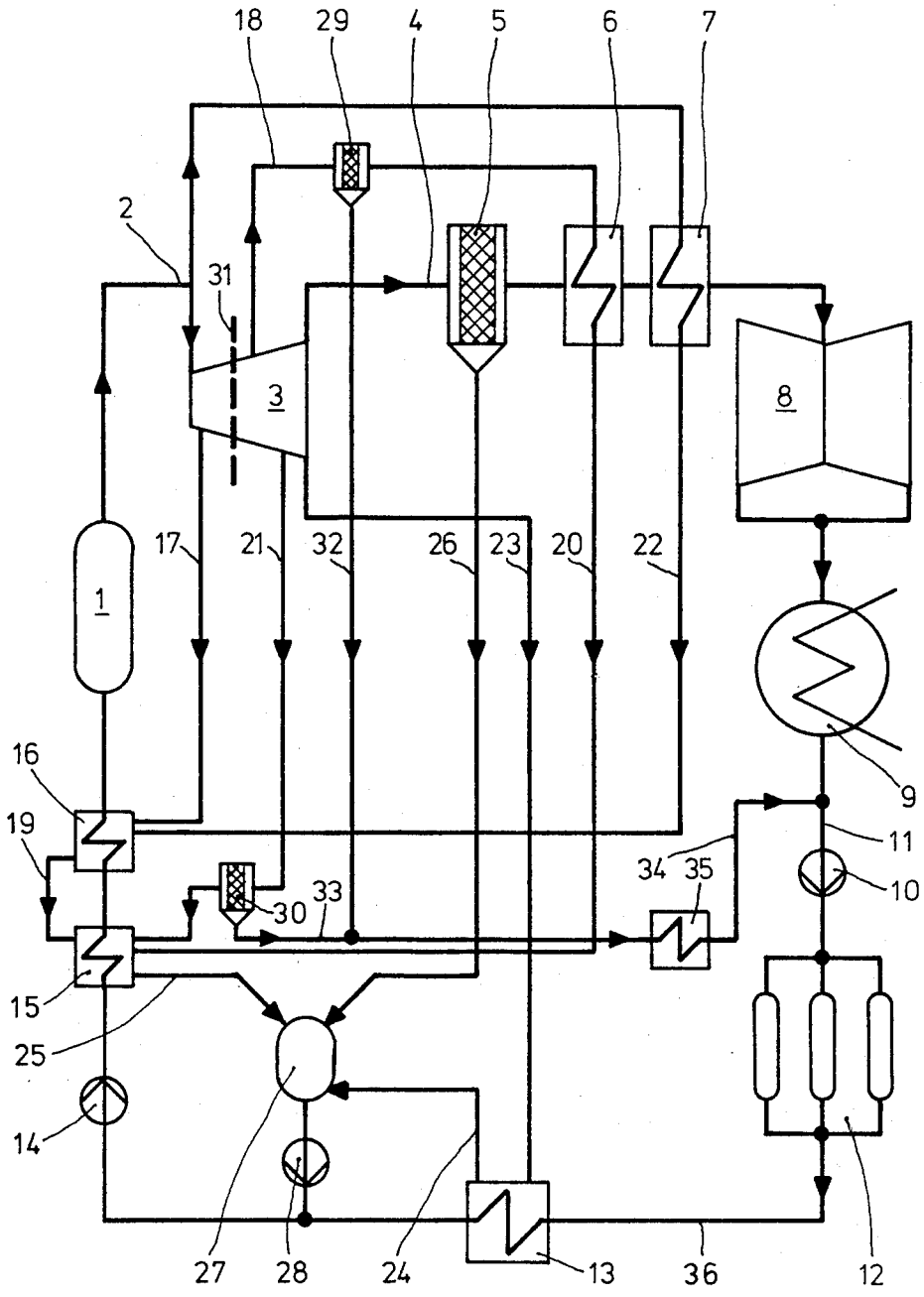
18
29
4
5
6
7
2
31
3
8
17
21
32
26
23
20
22
1
16
9
19
11
34
35
10
30
33
15
25
14
27
28
24
13
36
12

PROCESS OF REMOVING WATER-SOLUBLE IMPURITIES FROM THE WORKING MEDIUM OF A STEAM POWER PLANT

BACKGROUND AND SUMMARY OF THE INVENTION

The invention relates generally to a process for removing water-soluble impurities from the working medium of a steam turbine power plant.

In steam turbine plants using a type of steam generator in which the impurities can not be removed by washing it is necessary to prevent the impurities from reaching the steam turbine and its auxiliary components. The impurities, which enter or occur within the circulating system, such as in the cooling water or added contaminated feedwater may backflow from the unit purifying the condensation product. Instances are known where plant components were destroyed by stress-crack corrosion or other types of chemical corrosion in which impurities in the working fluid were the cause.

Published German Patent Application No. 1,178,861 discloses a known process in which the condensation product, accumulated inside the turbine between the blades and in the drains of the bleeder pipes is collected and then purified in a separate ion exchanger. Such an arrangement eliminates the need for a standard filter for cleaning the entire condensation product collected in the "hotwell".

A process in which the entire condensation product accumulating in the turbine unit upstream of the actual condenser is purified is not suitable for all types of power plants. Those plants which require the use of a unit which purifies the condensation product to supply high-quality feed water and which will recirculate up to 40% of the total condensation product accumulated within the plant cannot use the process described in the German Plant application. If all of the condensation products are centrally collected, the concentration of the impurities will not be very high. In view of the large volume of condensation products, the required purification unit must by necessity be relatively large. Costly heat-exchange surfaces are needed to cool the hot condensation product down to the purification temperature.

The main source of water-soluble impurities in the feedwater is the condensate purification unit. Depending upon the degree of exhaustion of the chemicals, a certain ionic leakage occurs through which electrolytes, particularly sodium hydroxide and sodium chloride, are introduced into the loop. Since certain steam generators (e.g., once-through steam generators in nuclear plants or once-through boilers run on fossil fuel) cannot be cleaned by a conventional blowdown process, such impurities can only be removed from the condensate by the purification unit which functions by means of an ionic exchange. Typically, the feedwater is pumped to the high-pressure loop without passing through the polishing plant so that a substantial portion of the feedwater does not pass through the condensate purification unit. Therefore, a continuous release of impurities results, with a corresponding constant increase in the concentration of impurities within the high-pressure loop.

One solution would be to eliminate the forward pumping to a condensate tank and have the condensates cascaded into the condenser and cleaned in the condensate purification unit. This process would, however, require several expensive recuperative heat exchangers in order to cool the 200° C. condensate to less than 50° C.

This temperature reduction is necessary because a certain decomposition of anionic exchange resin takes place at high temperatures which over a longer period of time could impair the operation of the condensate purification unit. In a cascading system, the purification unit would have to be large enough to treat the entire amount of condensate, as opposed to the recirculating system in which a portion of the condensate bypasses the purification unit. To clean about 50% more condensate an additional exchange capacity would have to be provided for, otherwise all condensates would flow through the existing purification system at a higher speed. The increased speed and greater condensate flow reduces the desired degree of cleanliness sought to be achieved and exhausts the resins faster, thereby requiring their more frequent regeneration.

Using the present invention, an already existing system can be improved as follows. The improvement is based upon the consideration that during the expansion of slightly superheated steam in the high-pressure turbine, the steam, at the point of crossing the saturation line, still behaves as if it were superheated since it is unstable. In the Wilson Line area, a steam humidity of approximately 3%, the steam stabilizes and partially condenses, resulting in the formation or water drops.

This initial condensate contains highly-concentrated water-soluable impurities (similar to the opposite phenomenon, distillation) which can be removed from the high-pressure loop before being diluted by increased condensation during further expansion of the steam. This removal takes place at the bleeding points of the turbine which are arranged downstream from the Wilson Line region. If the condensate from this bleed steam (about 13% of the entire working medium) is recirculated as before, then all impurities would remain in the loop. The bled steam contains a relatively large portion of the impurities within the circulating working medium. The bled steam is therefore passed through moisture separators which remove the condensation products from the steam. The impurities are removed from the recirculated feedwater by passing the collected condensate through the purification unit.

An object of the present invention is to provide a purification process in which already existing installations may be modified without adding costly new equipment. The addition of the condensate treatment system considerably increases the reliability of the power plant. In building new power plants, the location of the bleed steam points can be predetermined, which provides for an optimum steam generation process and enhances the separation of impurities from the condensate.

BRIEF DESCRIPTION OF THE DRAWING

A prefered embodiment of the present invention will be described with reference to a single drawing in which like members bear like reference numerals. The single drawing is a schematic of a steam turbine power plant including the condenstate-treatment system of the present invention.

DETAILED DESCRIPTION OF THE PREFERRED EMBODIMENT

With reference to the single drawing, a steam generator 1, for example, a once-through boiler without blowdown, is known to be operated with high-quality feedwater.

The drawing shown is extremely simplified: elements irrelevant to the invention, e.g., the generator, the bleed lines of the low-pressure turbine, parts of the low-pressure heaters line, control and instrumentation equipment, etc., are not displayed. The direction of flow of the working agent is indicated by means of arrows. Slightly superheated steam is supplied through the live steam pipe 2 and enters the high-pressure turbine 3, where it is expanded to release energy. This expansion of the wet steam leads to an unacceptably high degree of water in the exhaust gases of the turbine. In order to reduce this excess humidity a moisture separator 5 is provided in the crossover line 4 which delivers the steam to a low pressure turbine 8. The dried steam is then reheated in a two-stage process in order to reduce the final moisture. The steam flows through a first reheater 6 heated by steam bled from the high-pressure turbine 3 and then into a second reheater 7 heated by live steam from the steam generator 1.

The reheated working steam is expanded in the multiple-flow low-pressure turbine 8 and enters a condenser 9, in this case a surface heat exchanger. An extraction pump 10 pumps the raw condensate through the main condensate pipe 11 into the condensate purification unit 12. In the drawing, the purification unit is shown as three parallel mix-bed filters, which can be selectively shut off or connected, depending upon the degree of exhaustion of the resins. The cleansed condensate then flows as boiler feedwater through the low-pressure heater system shown by a single low-pressure heater 13 and a feedwater pipe 36. The feedwater pump 14 introduces the condensate through first and second high-pressure reheaters 15, 16, respectively, and then to the steam generator 1.

Feedwater flowing through the high-pressure heater 16 closest to the boiler is partially heated by steam from a first bleed line 17 of the high-pressure turbine 3. After flowing through the high-pressure heater 16 this steam retains enough heat to heat the water flowing through the high-pressure heater 15, which is connected to heater 16 by a pipe 19.

Steam is supplied to the superheater 6 from the high-pressure turbine 3 through a bleed line 18 in order to heat the dried steam from the moisture separator 5. The partially spent steam exiting the super heater 6 is introduced through the connection pipe 20 into the high-pressure heater 15 to heat the boiler feedwater.

A third bleed point of the high-pressure turbine 3 is connected by a connection pipe 21 to the high-pressure heater 15. The high-pressure feedwater flowing through heater 15 is therefore heated by three different steam flows.

The steam bled from the turbine at 18 and 21 is partially condensed, having passed through the Wilson Line region within the turbine, which is shown by a dotted line 31. The removal of the condensate from the steam will be discussed below.

A portion of the live steam generated by the steam generator 1 is supplied to the second stage 7 of the reheater to heat the working steam which has been already dried in moisture separator 5. The steam is then supplied to the high-pressure heater 16, which is connected to the superheater 7 by a connection pipe 22. Recirculated feedwater flowing through heater 16 is therefore heated by two steam flows.

A portion of the exhaust steam from the high-pressure turbine 3 flows through a connection pipe 23 to the low pressure heater 13, where it heats the discharge of the polishing plant.

Turbine installations and their operation are known up to this point. Also known is that at least those condensates forming in the high-pressure loop are recirculated through the power plant. The high-pressure feedwater is normally pumped through feedwater pump 14 into feedwater pipe 36 and circulates in the high-pressure loop. This feedwater is therefore not subjected to purification in the condensate polishing plant 12.

In the present invention, the condensed steam which is recirculated is composed of three flows. The first flow is the condensate of the heating steam of the low-pressure heater 13, the second is the heated steam which has been condensed after passing through the high-pressure heater 15, and the third is the condensate separated in the moisture separator 5. These three separate streams are drained out of the corresponding apparatus through secondary condensate pipes 24, 25 and 26 into the condensate tank 27. The collected condensate is then pumped from the condensate tank 27 into the feedwater pipe 36 by pump 28. Moisture separators 29 and 30, respectively, are located in the connection pipes 18 and 21 which carry steam from the second and third bleed points of high-pressure turbine 3 and through which a mixture of water and steam flows. The water removed in the separators 29 and 30, which because of the relatively low moisture content of the corresponding steam is typically less than 1% of the volume of water normally processed in the condensate purification unit, contains approximately 10% of the water-soluable impurities present in the live steam.

If the condensate of the moisture separator 5, which is connected downstream of the high-pressure turbine, were cooled, cascaded and cleaned in the condensate purification unit, relatively fewer impurities would be removed from the loop. This less efficient cleaning results from the increased volume of condensate flow. Since the concentration of the impurities in the mositure separator 5 condensate is less than the concentration of the impurities contained in the moisture extracted in moisture separators 29 and 30, a less effective feedwater cleaning system would result.

The drains of moisture separators 29 and 30 are connected through pipes 32, 33 to a heat exchanger 35 in which the water is cooled, to a suitable temperature. The water is then supplied through pipe 34 into a condensate pipe 11 which is connected to the condensate purification unit 12. Alternatively, the water may be discarded and replaced by make-up water. p Depending on where the Wilson Line region occurs within the turbine, the moisture separators could be located in the crossover pipe 4. In building new power plants, the separators may be integrated in a similar fashion into the turbine casing.

Another modification of the present invention would be to completely or partially discard or reclean the drains of other moisture separators, such as the moisture separator 5, in addition to using moisture separators 29 and 30. These condensates contain approximately 70% of the inpurities in the system.

The principles, prefered embodiments, and modes of operation of the present invention have been described in the foregoing specification. The invention is not to be limited to the particular forms disclosed, which are illustrative and not restrictive examples. Variations and changes may be made by those skilled in the art without departing from the scope and nature of the invention.

What is claimed is:

1. A process for removing water-soluble inpurities from the working medium of a steam turbine power plant of the type having a condensate purifying unit for receiving cooled liquid condensate after expansion and then returning the liquid condensate to a steam generator, and conducting super heated steam to a steam turbine where the steam produces work upon expansion in the turbine, said process comprising:

conducting the working medium from the last stage of said turbine to a main moisture separator;

conducting liquid from said main mositure separator to the inlet of said steam generator independently of said purifying unit;

bleeding working medium from said turbine at a location where the steam has a humidity greater than 3 percent and before said last stage;

conducting said bleed medium to an auxiliary moisture separator;

conducting liquid from said auxiliary separator through said purifying unit to the inlet of said steam generator.

2. The process according to claim 1 including conducting the dry steam from said auxiliary separator in heat exchange relation with dry steam from said main moisture separator.

3. The process according to claim 1 including bleeding working medium from said turbine at a second location where the steam has a humidity greater than 3 percent and before said last stage, conducting said bleed medium to a second auxiliary moisture separator, and conducting the dry steam from said second auxiliary separator in heat exchange relation with feed water flowing to said steam generator.

4. The process according to claim 1 including conducting the liquid condensate from the auxiliary separator to said purifying unit.

5. The process according to claim 3 including conducting the liquid condensate from said auxiliary separators to said purifying unit.

6. The process according to claim 1 including cooling the liquid from said auxiliary separator before conducting said liquid to said purifying unit.

* * * * *